United States Patent [19]

Greene, Jr. et al.

[11] Patent Number: 4,850,301

[45] Date of Patent: Jul. 25, 1989

[54] APPARATUS FOR APPLYING LIQUID ADDITIVES TO A CONTINUOUS, MULTIFILAMENT TOW

[75] Inventors: Carl C. Greene, Jr., Winston-Salem; Joseph H. Warden, Lewisville, both of N.C.

[73] Assignee: R. J. Reynolds Tobacco Company, Winston-Salem, N.C.

[21] Appl. No.: 176,965

[22] Filed: Apr. 4, 1988

[51] Int. Cl.[4] ..... B05C 1/06

[52] U.S. Cl. ..... 118/255; 28/283; 118/223; 118/234; 118/266

[58] Field of Search ..... 118/234, 266, 267, 223, 118/255, 268; 427/175, 429; 28/282, 283

[56] References Cited

U.S. PATENT DOCUMENTS

| | | | |
|---|---|---|---|
| 2,781,021 | 2/1957 | Schmitz | 118/266 X |
| 3,099,594 | 7/1963 | Caines et al. | 156/152 |
| 3,157,536 | 11/1964 | Caines | 118/225 |
| 4,033,290 | 7/1977 | Dude | 118/266 |
| 4,509,452 | 4/1985 | Pryor | 118/234 |
| 4,513,485 | 0/1985 | Cutts et al. | 28/181 |

*Primary Examiner*—Evan Lawrence

[57] ABSTRACT

Apparatus for applying a liquid additive to a continuous, multifilament tow includes a nonrotating tubular body and a nonmetallic element associated with the wall of the tubular body for contacting the multifilament tow as it is moved across the surface of the nonmetallic element. The nonmetallic element has an arcuate, external surface that is provided with a plurality of spaced openings formed in the nonmetallic element and which are in communication with an enclosure within the tubular body. Liquid additive is supplied to the enclosure and is transferred to the arcuate, external surface via the plurality of spaced openings for application to the multifilament tow as it contacts the arcuate, external surface of the nonmetallic element.

16 Claims, 2 Drawing Sheets

APPARATUS FOR APPLYING LIQUID ADDITIVES TO A CONTINUOUS, MULTIFILAMENT TOW

TECHNICAL FIELD

This invention relates to the application of liquid additives to moving bands of continuous, multifilament tows to produce bundles of treated tow having the liquid additives uniformly distributed throughout the tow. The invention is particularly suited to the processing of multifilament tows used in the manufacture of smoke filters for smoking products.

BACKGROUND ART

In a number of manufacturing operations involving the use of continuous filaments of material, it is desirable to apply various liquid additives to the filaments to provide useful benefits in connection with such manufacturing operations. The liquid additives may be lubricants, sizing solutions, finish compositions, plasticizers, etc. which impart desired characteristics to the treated filaments in a product manufactured therefrom or which provide some degree of protection to the filaments as they are being processed in the manufacturing operations. Since many manufacturing operations employ a rope of tow consisting of a large number of individual filaments, the uniform application of liquid additives to filaments making up the rope or tow is difficult to achieve.

One particular manufacturing operation in which multifilament tows are used is the production of filter rods for smoking products such as cigarettes. Filaments of cellulose acetate are typically gathered into a rope or tow and the tow is then treated with desired amounts of a plasticizer and/or other suitable additives before forming the treated cellulose acetate into a continuous filter rod that is subsequently cut to desired lengths. The plasticizer applied to the tow improves the firmness of the formed filter rod with the firmness being dependent on the extent to which the individual filaments in the tow have been coated with plasticizer. Two basic methods are used at the present time to apply plasticizer to filter tow. One method utilizes spraying or similar devices for applying plasticizer to both sides of a flattened, spread out band of filter tow. The other method involves contacting each side of a flattened band of tow with a surface that is continuously wetted with plasticizer. The latter method may employ either rotating surfaces such as roller devices or stationary surfaces across which the band of tow moves.

Disclosed in U.S. Pat. No. 3,157,536 is apparatus which employs two cooperating applicators for applying plasticizer to filter tow. Each applicator includes a stainless steel tube that is provided with a narrow slit longitudinally disposed along one side of the tube. Stainless steel mesh or screen fabric concentrically surrounds the tube and a porous felt material is interposed between the steel tube and steel screen so that the narrow slit is completely covered by the felt. Plasticizer is forced under pressure into the tube from which it exits through the narrow slit, the porous felt material and the overlying steel mesh or screen fabric. A continuous filter tow is brought into contact with the applicators so that one side of a flat band of the tow is pulled across the wire screen of one applicator and the opposite side of the band of tow is pulled across the wire screen of the second applicator. Although the disclosed applicators are effective for the treatment of filter tow, they do have certain disadvantages associated therewith. For example, the applicators require a 16 hour "break-in" period and they undergo sufficient wear during use to make replacement necessary after a few months' use. Also, the applicators must be dismantled frequently for cleaning purposes and great care must be exercised during the cleaning operation to avoid damage to the wire screen. Slight abrasions to the tow-contacting surface of the wire screen will lead to excessive generation of lint in the filter tow and the filter rod formed from the tow. In addition to the undesirable effects on the characteristics of the formed filter rod caused by a damaged wire screen, the time required to perform routine cleaning and maintenance of such applicators is very substantial. Thus, the "down time" associated with the use of the wire screen applicators has a very significant economic impact on a filter rod manufacturing operation which employs such applicators.

BRIEF SUMMARY OF THE INVENTION

The presently disclosed invention provides an improved apparatus and method for applying a liquid additive to a continuous, multifilament tow which involves contacting a moving band of multifilament tow with a nonrotating tubular body having associated therewith an arcuate, external surface formed from nonmetallic material that is designed to contact the tow. The arcuate, external surface is provided with a plurality of spaced openings which are in communication with an enclosure containing a supply of the liquid additive. A porous wick material positioned within the tubular body contiguous to the spaced openings serves to transfer uniformly via the spaced openings the liquid additive from the interior portion of the tubular body to the arcuate, external surface where it is applied to the moving band of multifilament tow.

DETAILED DESCRIPTION OF THE INVENTION

Figure 1:
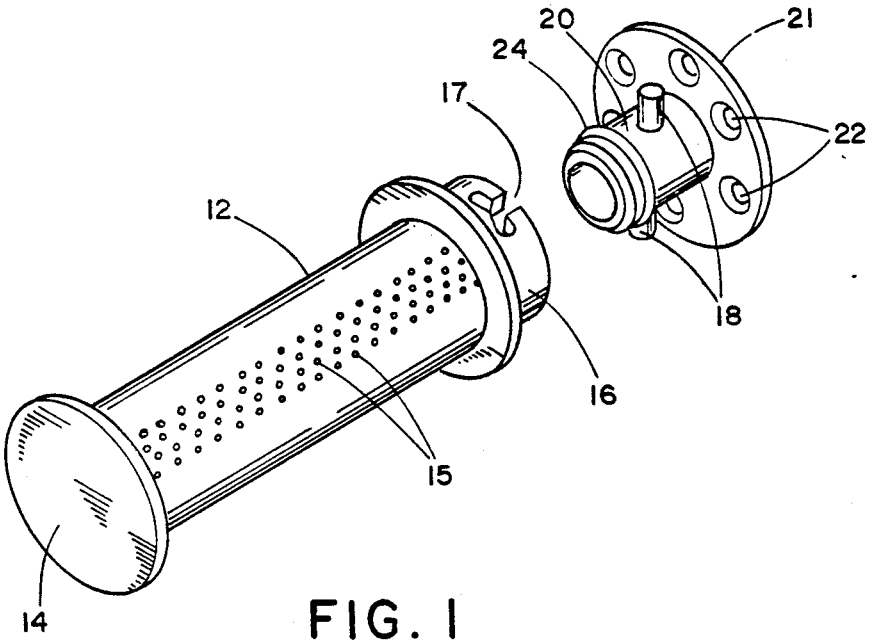
FIG. 1 is a perspective view of a liquid applicator in accordance with this invention showing the means for attaching the liquid applicator to apparatus for processing a multifilament tow.

The invention disclosed herein is based primarily on an improved design for a nonrotating type of liquid applicator. The applicator is adapted to receive a flattened band of continuous, multifilament tow in a contacting relationship for applying desired amounts of liquid additive to the tow. The liquid applicator comprises a nonrotating tubular body having a first end that is adapted for attachment to a support member and a second end opposite to the first end that is provided with sealing means cooperating with the internal surfaces of the tubular body to define an enclosure within the tubular body. The wall of the tubular body intermediate its first and second ends is of sufficient thickness to provide an essentially rigid structure. Associated with the wall of the tubular body is a nonmetallic element having an arcuate, external surface that is designed to contact the moving band of continuous, multifilament tow. The nonmetallic element associated with the tubular body is provided with a plurality of spaced openings which are in communication with the enclosure within the tubular body and the arcuate, external surface that is contacted by the moving band of tow. A porous wick material is positioned within the enclosure of the tubular body contiguous to the plurality of spaced openings. Liquid additive is delivered to the enclosure within the tubular body from liquid additive supply means via the first end that is attached to a support member. The liquid additive is transferred from the enclosure to the arcuate, external surface via the porous wick material and the plurality of spaced openings for application to the moving band of multifilament tow as it contacts the nonmetallic element.

The particular processing arrangement for the multifilament tow treated in accordance with this invention is not critical so long as a sufficient quantity of liquid additive is applied to the tow for purposes of the intended product. It is generally desirable, however, to subject the tow to spreading and tensioning forces to form the tow into a flattened band before the tow is brought into contact with the nonmetallic element of the tubular body. This will ensure that a maximum number of individual filaments will be contacted with the liquid additive by the applicator. Devices for shaping the tow into a flattened band are known in the art and include pneumatic banding jets and circumferentially grooved rolls.

The dimensions of the liquid additive applicators of this invention should be such that the maximum width of the flattened band of tow can be accommodated by the tow-contacting surface of the tubular body. The transverse cross-sectional shape of the tubular body is not critical and may be circular, semicircular, oval, etc. If the tubular body of the applicator is to serve directly as the tow-contacting surface, it is important that the portion of the tubular body contacted by the tow be fabricated from a nonmetallic material and that it be arcuate in shape. The tubular body may also be a composite structure formed from metallic and nonmetallic materials so long as the tow-contacting surface associated with the tubular wall is nonmetallic. Nonmetallic materials which may be used for fabricating the arcuate, tow-contacting surface include ceramic materials and thermoplastics such as polyolefins and polyamides. Particularly preferred are high density polyethylene and polypropylene.

The arcuate, nonmetallic tow-contacting surface of the tubular body is provided with a plurality of holes or openings through which the liquid additive flows. The number of holes or openings will depend on the width of the flattened band of tow and the quantities of liquid additive that are to be applied to the tow. The openings are preferably arranged in rows that extend in a direction that is substantially transverse to the direction of movement of the tow. The diameter of each hole or opening should be between 0.5 mm and 1.0 mm and, preferably, between 0.70 mm and 0.85 mm. The distance between adjacent holes should generally not exceed 5.0 mm and should preferably be between 1.0 mm and 4.0 mm. If more than one row of holes or openings is employed, the holes in adjacent rows should be staggered or offset so that liquid additive is distributed as uniformly as possible across the width of the tow. The tow-contacting surface which surrounds the spaced openings should be relatively smooth to minimize frictional drag and lint generation.

Since the liquid additive emerging from the spaced openings tends to act as a lubricant on the tow-contacting surface of the tubular body, there is a tendency for the filaments of the tow to move from a wide, flat band configuration to a narrow, rope-like configuration. This tendency can be minimized by positioning appropriate feed rolls upstream and downstream of the liquid additive applicator for maintaining a desired width of the flat band of tow. An alternative technique for maintaining tow width involves the use of a convex tow-contacting surface on the tubular body. The convex shape causes the tow filaments to move outwardly (i.e., toward each edge of the flattened band of tow) thereby counteracting the tendency of the tow filaments to move inwardly. Other methods known in the art may also be used to maintain a spread tow configuration.

Distribution of liquid additive to all of the spaced holes or openings is accomplished by positioning a porous wick material within the enclosure of the tubular body contiguous to the spaced openings. A felt material formed from natural and/or synthetic fibers is suitable for this purpose. If necessary, appropriate retaining means are used to hold the felt in a contiguous position with respect to the spaced openings. Liquid additive is absorbed by the felt material and is distributed throughout its fibrous structure. Thus, the felt material serves as a wick which continuously transfers liquid additive to the spaced openings where it moves by capillary action to the tow-contacting surface. The felt material should be easily removable from the enclosure and it is generally replaced when the liquid additive applicators are periodically removed for cleaning.

The manner in which the liquid additive applicators are attached to the tow processing apparatus is of particular interest if frequent changes in the composition of the liquid additive are anticipated. For example, the processing of filter tow for manufacturing filter rods for smoking products involves the application of plasticizer to the tow. Since the plasticizer composition usually includes low levels of flavoring materials which are unique for a particular brand of smoking product, the liquid additive applicator must be cleaned before manufacturing the filters for each brand. It is desirable, therefore, to provide the applicator with means for quickly attaching and removing it from the tow processing apparatus. Various designs of fastening and retaining devices are known including, for example, clip fasteners and twist-lock designs. The particular design employed for this invention is not critical.

In many instances it is desirable to apply liquid additive to both sides of a flattened band of multifilament tow. This is easily accomplished by employing two applicators positioned in a cooperating relationship in a manner similar to that described in U.S. Pat. No. 3,157,536. In such an arrangement the multifilament tow is moved sequentially across the tow-contacting surface of each applicator so that one side of the band of tow is contacted by the tow-contacting surface of the first applicator and the opposite side of the band of tow is contacted by the tow-contacting surface of the second applicator. If desired, the treated tow may be subjected to further treatment such as a stream of pressurized air to promote more uniform distribution of liquid additive throughout the tow or to effect rearrangement of individual filaments so that additive-treated filaments will be randomly dispersed within the bundle of filaments making up the tow.

For a more complete understanding of this invention, reference will now be made to the drawings which illustrate certain aspects of this invention in more detail.

Shown in FIG. 1 is one embodiment of the presently disclosed liquid additive applicators. Tubular body 12 is fabricated from a thermoplastic material such as high density polyethylene and is essentially cylindrical in shape. End flange 14 is secured to one end of the tubular body and the opposite end comprises a cylindrically shaped extension 16 that is provided with two diametrically opposed, T-shaped slots 17 which are designed to engage retaining pins 18 attached to liquid additive supply conduit 20. Bolts installed in holes 22 of flange 21 secure the flange and conduit 20 associated therewith to the tow processing apparatus. An O-ring 24 positioned in a circumferential groove on the outer surface of conduit 20 provides a liquid-tight seal with a mating surface on the inner wall of extension 16. Formed in a portion of the wall of tubular body 12 are a plurality of spaced openings or holes 15 which extend from the enclosure within tubular body 12 to the outer surface that is contacted with a flattened band of multifilament tow. Liquid additive from a suitable supply source (not shown) is pumped into the enclosure within tubular body 12 via conduit 20 and passes through the spaced openings 15 during operation of the apparatus. Flanges 13 and 14 serve to retain the flattened band of tow on the applicator as the tow is moved across the outer surface of tubular body 12. End flange 14 serves also as sealing means for one end of the enclosure within tubular body 12.

Figure 3:
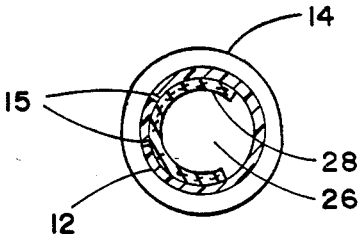
FIG. 3 is a cross-sectional view of the body of the liquid applicator shown in FIG. 2 taken along a plane passing through section line 3—3 of FIG. 2.
Figure 2:
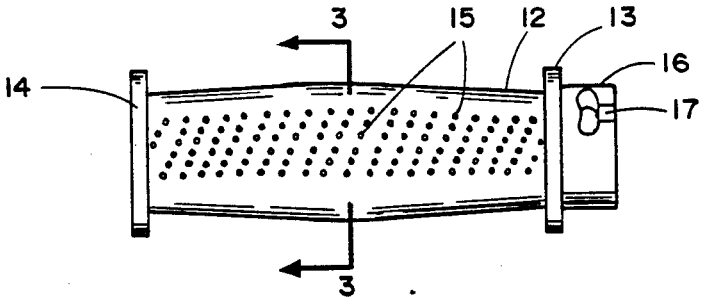
FIG. 2 is a side elevational view of a preferred embodiment of the liquid applicator disclosed herein.

The preferred embodiment of the liquid additive applicator depicted in FIG. 2 is a slightly modified version of the device shown in FIG. 1. In the FIG. 2 design the outside diameter of tubular body 12 in the area of section line 3—3 is somewhat greater than the outside diameter near each of flanges 13 and 14. In the side elevational view shown the difference in outside diameter produces a convex-shaped surface that prevents the edges of the flattened band of tow from being drawn inwardly toward the central portion of the tow. The spaced openings 15 are arranged in five rows which extend in a direction that coincides approximately with the longitudinal axis of tubular body 12. The cross-sectional view of FIG. 3 shows the positioning of porous felt material 28 within enclosure 26 contiguous to spaced openings 15.

Figure 4:
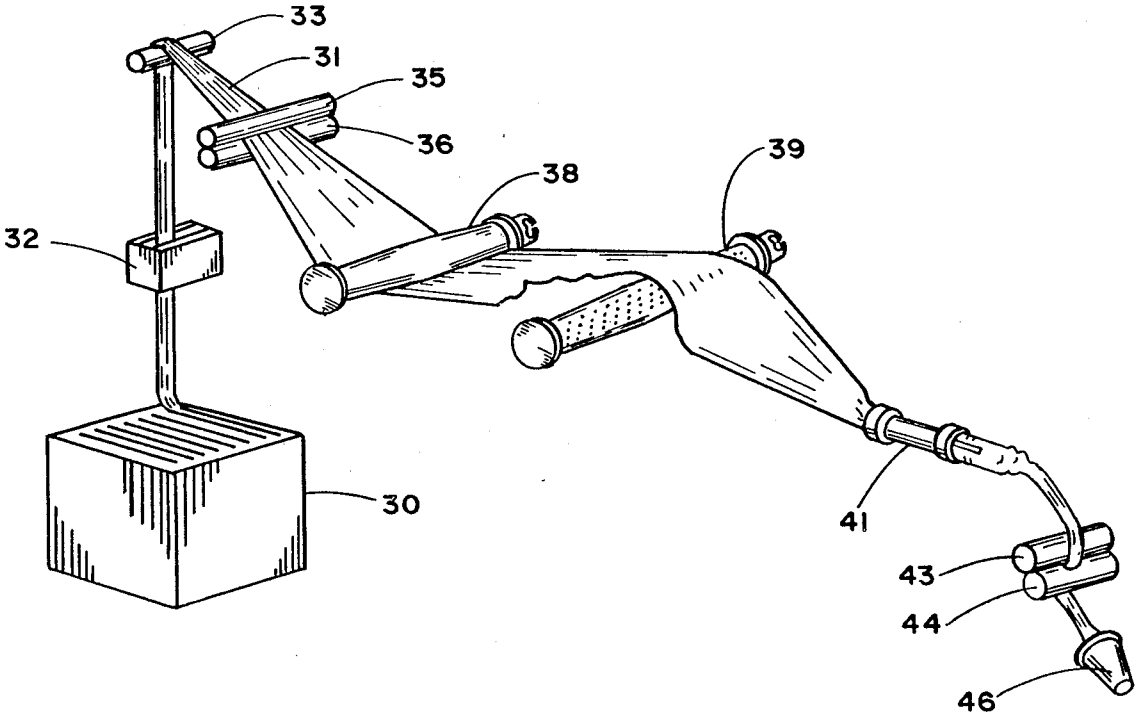
FIG. 4 is a perspective view partially in section of apparatus for processing a multifilament tow using the liquid applicators of this invention.

A typical arrangement for processing a multifilament tow for the manufacture of filters for cigarettes is shown in FIG. 4. A continuous tow 31 is withdrawn from tow supply container 30 by feed rolls 35 and 36 and is directed through pneumatic banding jet 32 and over guide roll 33. The combined action of banding jet 32 and guide roll 33 produces a flattened, thin band of filter tow. Liquid additive applicators 38 and 39 having a design similar to that shown in FIGS. 2 and 3 are contacted sequentially by the moving band of tow. Liquid additive comprising a plasticizer is fed from a supply source (not shown) to applicators 38 and 39 and is applied to each side of the flattened band of tow. The treated tow then passes through blooming jet 41 where a high velocity gas stream exerts sufficient tension on the filter tow to move the tow across the tow-contacting surfaces of applicators 38 and 39. Bloomed tow exiting from blooming jet 41 passes between delivery rolls 43 and 44 before proceeding to the entrance to the garniture section of a filter rod forming apparatus represented by funnel 46.

The effectiveness of the liquid additive applicators disclosed herein was evaluated by making a direct comparison with applicators constructed in accordance with the teachings of U.S. Pat. No. 3,157,536. A tow processing arrangement similar to that shown in FIG. 4 and incorporating therein two liquid applicators similar to that depicted in FIG. 1 was used to manufacture filter rods for cigarettes. Filter rods were also manufactured with an identical tow processing arrangement but substituting for the FIG. 1 applicators two stainless steel applicators similar in design to those shown in U.S. Pat. No. 3,157,536. The plasticizer applied to the tows in each case contained a dye so that distribution of plasticizer in the formed filter rods could be visually observed. An inspection of the formed filter rods revealed that a more uniform distribution of plasticizer was obtained using the presently disclosed applicators whereas the stainless steel applicators resulted in plasticizer distribution that was marbled in appearance. This difference in plasticizer distribution was confirmed by measurements which indicated that filter rods produced using the instant invention possessed greater firmness than filter rods formed with the stainless steel applicators installed.

The embodiments described above clearly indicate the advantages of the present invention. Other embodiments and modifications will be apparent to those skilled in the art without departing from the spirit and scope of the appended claims.

What is claimed is:

1. Apparatus for applying a liquid additive to a moving band of continuous, multifilament tow comprising (a) a nonrotating tubular body having a first end adapted for attachment to a support member and a second end opposite to said first end, said tubular body having intermediate its first and second ends a wall of sufficient thickness to provide an essentially rigid structure, (b) sealing means associated with said second end and cooperating with the internal surfaces of the tubular body to define an enclosure within the tubular body, (c) liquid additive supply means for delivering liquid additive via said first end to the enclosure within the tubular body, (d) a nonmetallic element associated with the wall of the tubular body and having an arcuate, external surface that is designed to contact the moving band of continuous, multifilament tow, (e) a plurality of spaced openings formed in the nonmetallic element, said openings being in communication with both said enclosure within the tubular body and said arcuate, external surface and (f) a porous wick material positioned within said enclosure contiguous to said plurality of spaced openings, said wick material being a felt pad capable of absorbing the liquid additive delivered to the enclosure and of transferring the liquid additive via the spaced openings to the arcuate, external surface for application to the moving band of continuous, multifilament tow as it contacts and arcuate, external surface.

2. The apparatus of claim 1 wherein the spaced openings formed in the nonmetallic element associated with the wall of the tubular body comprise a plurality of rows of openings that extend in a direction that is substantially transverse to the direction in which the tow is moving, the length of each row of openings corresponding approximately to the width of the moving band of tow as it contacts said arcuate, external surface.

3. The apparatus of claim 2 wherein the spaced openings are substantially circular in cross-section with each opening having a diameter between 0.5 mm and 1.0 mm.

4. The apparatus of claim 3 wherein the spaced openings are arranged in six rows extending in a transverse direction with respect to the direction in which the tow is moving, the distance between adjacent rows of openings being between 1.0 mm and 4.0 mm and each row of openings being offset with respect to each row or rows of openings immediately adjacent thereto.

5. Apparatus for applying a liquid additive to a moving band of continuous, multifilament tow comprising (a) two cooperating, nonrotating tubular bodies each having a first end adapted for attachment to a support member and a second end opposite to said first end, said tubular bodies having intermediate their first and second ends a wall of sufficient thickness to provide an essentially rigid structure, (b) sealing means associated with the second end of each tubular body which, in cooperation with the internal surface of each tubular body, defines an enclosure within each tubular body, (c) liquid additive supply means for delivering liquid additive via each said first end to the enclosure within each tubular body, (d) a nonmetallic element associated with the wall of each tubular body, each nonmetallic element having an arcuate, external surface that is designed to contact the moving band of continuous, multifilament tow, (e) a plurality of spaced openings formed in each nonmetallic element, said openings being in communication with the respective enclosure within each tubular body and the respective arcuate, external surface of each nonmetallic element, (f) a porous wick material positioned within each enclosure contiguous to said plurality of spaced openings, said wick material being a felt pad capable of absorbing the liquid additive delivered to each enclosure and of transferring the liquid additive via the spaced openings to the respective arcuate, external surface of the nonmetallic element of each tubular body and (g) means associated with said support member for retaining the nonrotating tubular bodies in a cooperating, positional relationship so that one side of the moving band of continuous, multifilament tow is contacted with the arcuate, external surface of the nonmetallic element associated with the first tubular body and the opposite side of the moving band of continuous, multifilament tow is contacted with the arcuate, external surface of the nonmetallic element associated with the second tubular body.

6. The apparatus of claim 5 wherein the spaced openings formed in the nonmetallic element associated with the wall of each tubular body comprise a plurality of rows of openings that extend in a direction that is substantially transverse to the direction in which the tow is moving, the length of each row of openings corresponding approximately to the width of the moving band of tow as it contacts said arcuate, external surface.

7. The apparatus of claim 6 wherein the spaced openings are substantially circular in cross-section with each opening having a diameter between 0.5 mm and 1.0 mm.

8. The apparatus of claim 7 wherein the spaced openings are arranged in six rows extending in a transverse direction with respect to the direction in which the tow is moving, the distance between adjacent rows of openings being between 1.0 mm and 4.0 mm and each row of openings being offset with respect to each row or rows of openings immediately adjacent thereto.

9. Apparatus for applying a liquid additive to a moving band of continuous, multifilament tow comprising (a) a nonrotating tubular body having a first end adapted for attachment to a support member and a second end opposite to said first end, said tubular body having intermediate its first and second ends a wall of sufficient thickness to provide an essentially rigid structure, (b) sealing means associated with said second end and cooperating with the internal surfaces of the tubular body to define an enclosure within the tubular body, (c) liquid additive supply means for delivering liquid additive via said first end to the enclosure within the tubular body, (d) a nonmetallic element associated with the wall of the tubular body and having an arcuate, external surface that is designed to contact the moving band of continuous, multifilament tow, said nonmetallic element being provided with an external surface area that is convex in shape with the central portion of the external surface are projecting outwardly from the longitudinal axis of the tubular body to a greater distance than the peripheral portions of the external surface area.

(e) a plurality of spaced openings formed in the nonmetallic element, said openings being in communication with both said enclosure within the tubular body and said arcuate, external surface and (f) a porous wick material positioned within said enclosure contiguous to said plurality of spaced openings, said wick material being a felt pad capable of absorbing the liquid additive delivered to the enclosure and of transferring the liquid additive via the spaced openings to the arcuate, external surface for application to the moving band of continuous, multifilament tow as it contacts said arcuate, external surface.

10. The apparatus of claim 9 wherein the spaced openings formed in the nonmetallic element associated with the wall of the tubular body comprise a plurality of rows of openings that extend in a direction that is substantially transverse to the direction in which the tow is moving, the length of each row of openings corresponding approximately to the width of the moving band of tow as it contacts said arcuate, external surface.

11. The apparatus of claim 10 wherein the spaced openings are substantially circular in cross-section with each opening having a diameter between 0.5 mm and 1.0 mm.

12. The apparatus of claim 11 wherein the spaced openings are arranged in six rows extending in a transverse direction with respect to the direction in which the tow is moving, the distance between adjacent rows of openings being between 1.0 mm and 4.0 mm and each row of openings being offset with respect to each row or rows of openings immediately adjacent thereto.

13. Apparatus for applying a liquid additive to a moving band of continuous, multifilament tow comprising (a) two cooperating, nonrotating tubular bodies each having a first end adapted for attachment to a support member and a second end opposite to said first end, said tubular bodies having intermediate their first and second ends a wall of sufficient thickness to provide an essentially rigid structure, (b) sealing means associated with the second end of each tubular body which, in cooperation with the internal surface of each tubular body, defines an enclosure within each tubular body, (c) liquid additive supply means for delivering liquid additive via each said first end to the enclosure within each tubular body, (d) a nonmetallic element associated with the wall of each tubular body, each nonmetallic element having an arcuate, external surface that is designed to contact the moving band of continuous, multifilament tow, said nonmetallic element being provided with an external surface area that is convex in shape with the central portion of the external surface area projecting outwardly from the longitudinal axis of the tubular body to a greater distance than the peripheral portions of the external surface area.

(e) a plurality of spaced openings formed in each nonmetallic element, said openings being in communication with the respective enclosure within each tubular body and the respective arcuate, external surface of each nonmetallic element, (f) a porous wick material positioned within each enclosure contiguous to said plurality of spaced openings, said wick material being a felt pad capable of absorbing the liquid additive delivered to each enclosure and to transferring the liquid additive via the spaced openings to the respective arcuate, external surface of the nonmetallic element of each tubular body and (g) means associated with said support member for retaining the nonrotating tubular bodies in a cooperating, positional relationship so that one side of the moving band of continuous, multifilament tow is contacted with the arcuate, external surface of the nonmetallic element associated with the first tubular body and the opposite side of the moving band of continuous, multifilament tow is contacted with the arcuate, external surface of the nonmetallic element associated with the second tubular body.

14. The apparatus of claim 13 wherein the spaced openings formed in the nonmetallic element associated with the wall of each tubular body comprise a plurality of rows of openings that extend in a direction that is substantially transverse to the direction in which the tow is moving, the length of each row of openings corresponding approximately to the width of the moving band of tow as it contacts said arcuate, external surface.

15. The apparatus of claim 14 wherein the spaced openings are substantially circular in cross-section with each opening having a diameter between 0.5 mm and 1.0 mm.

16. The apparatus of claim 15 wherein the spaced openings are arranged in six rows extending in a transverse direction with respect to the direction in which the tow is moving, the distance between adjacent rows of openings being between 1.0 mm and 4.0 mm and each row of openings being offset with respect to each row or rows of openings immediately adjacent thereto.

* * * * *